US005796017A

United States Patent [19]

Hauner

[11] Patent Number: 5,796,017

[45] Date of Patent: Aug. 18, 1998

[54] SILVER-BASED CONTACT MATERIAL, USE OF SUCH A CONTACT MATERIAL, IN SWITCHGEAR FOR POWER ENGINEERING APPLICATIONS AND METHOD OF MANUFACTURING THE CONTACT MATERIAL

[75] Inventor: Franz Hauner, Röttenbach, Germany

[73] Assignee: Siemens Aktiengesellschaft, Müchen, Germany

[21] Appl. No.: 601,059

[22] PCT Filed: Aug. 16, 1994

[86] PCT No.: PCT/DE94/00935

§ 371 Date: Feb. 23, 1996

§ 102(e) Date: Feb. 23, 1996

[87] PCT Pub. No.: WO95/06321

PCT Pub. Date: Mar. 2, 1995

[30] Foreign Application Priority Data

Aug. 23, 1993 [DE] Germany ..... 43 28 281.4
Mar. 25, 1994 [DE] Germany ..... 44 10 462.6

[51] Int. Cl.[6] ..... B22F 3/16; C22C 1/05; C22C 5/06

[52] U.S. Cl. ..... 75/232; 75/234; 75/247; 419/21; 419/38; 419/41; 419/53

[58] Field of Search ..... 75/232, 234, 247; 419/27, 38, 41, 53

[56] References Cited

U.S. PATENT DOCUMENTS

| | | | |
|---|---|---|---|
| 2,200,855 | 5/1940 | Ruben | 200/166 |
| 2,572,662 | 10/1951 | Richardson et al. | 75/247 |
| 2,985,532 | 5/1961 | Simon | 75/212 |
| 3,922,236 | 11/1975 | Douglas et al. | 252/514 |
| 4,426,356 | 1/1984 | Nair | 419/21 |
| 4,764,227 | 8/1988 | Rothregel et al. | 148/431 |
| 4,777,335 | 10/1988 | Okutomi et al. | 200/264 |
| 5,198,015 | 3/1993 | Tsuji et al. | 75/247 |
| 5,258,052 | 11/1993 | Bevington | 75/234 |
| 5,279,638 | 1/1994 | Asada et al. | 75/235 |
| 5,429,656 | 7/1995 | Hauner et al. | 75/232 |
| 5,591,926 | 1/1997 | Inada et al. | 75/247 |
| 5,610,347 | 3/1997 | Behrens et al. | 75/247 |

*Primary Examiner*—Daniel J. Jenkins
*Attorney, Agent, or Firm*—Kenyon & Kenyon

[57] ABSTRACT

Contact material based on silver, use of such a contact material in a switching device in power engineering, and process for preparing the contact material.

For contact pieces in low-voltage switches, in particular, substitute materials based on silver-iron oxide are proposed for the silver-nickel hitherto often used in practice. According to the invention, such a material contains, as a further effective component, an oxide of a metal of the third sub-group, yttrium oxide ($Y_2O_3$) being especially designed for this purpose. For example, a material of the composition $Ag/Fe_2O_3 10/Y_2O_3 1$ meets, with its favourable temperature behaviour, the properties required with respect to the contact property spectrum. In addition, at least one metal oxide which contains elements of the sixth sub-group of the Periodic Table of the Elements, preferably iron tungstate ($FeWO_4$), can be present. In particular, a material of the composition $Ag/Fe_2O_3 9/Y_2O_3 1/FeWO_4 0.5$ has shown good utility owing to its additionally improved welding and short-circuit behaviour.

18 Claims, No Drawings

SILVER-BASED CONTACT MATERIAL, USE OF SUCH A CONTACT MATERIAL, IN SWITCHGEAR FOR POWER ENGINEERING APPLICATIONS AND METHOD OF MANUFACTURING THE CONTACT MATERIAL

BACKGROUND OF THE INVENTION

The invention relates to a contact material based on silver, there being present, in addition to silver, iron oxide as the main effective component and at least one further effective component. The invention also relates to the use of such a contact material in a switching device in power engineering and to the associated process for preparing the contact material.

Known contact materials for contact pieces in low-voltage switching devices in power engineering, e.g. in circuit breakers and in D.C. contactors, motor contactors and contactor relays include those, on the one hand, of the system silver-metal (AgMe) and, on the other hand, of the system silver-metal oxide (AgMeO). Representatives of the first system are, for example, silver-nickel (AgNi) or silver-iron (AgFe); representatives of the second system are, in particular, silver-cadmium oxide (AgCdO) and silver-tin oxide ($AgSnO_2$). Further metal oxides such as, in particular, bismuth oxide ($Bi_2O_3$), copper oxide (CuO) and/or tantalum oxide ($Ta_2O_5$) may also be added.

The practical suitability of a contact material based on silver-metal or silver-metal oxide is determined by the so-called electrical "contact property spectrum". Important parameters in this context include the lifetime number of make-break operations on the one hand, which is determined by the erosion of the contact piece, and the so-called temperature rise on the other hand, i.e. the contact heating at the contact bridge and at the terminals which essentially results from the electrical resistance of the said contact construction. Also important are a sufficiently low welding tendency of the contact pieces and adequate corrosion resistance. For it should be noted that, owing to long-term corrosion of the material in air-break switching devices the switching properties may change over time.

DE-A-1 608 211 discloses an electrical contact material of the system silver-metal oxide which, in addition to cadmium or tin oxide, may also contain iron oxide. Further, DE-C-38 16 895 discloses the use of a silver-iron material containing from 3 to 30% by weight of iron and containing one or more of the additives manganese, copper, zinc, antimony, bismuth oxide, molybdenum oxide, tungsten oxide, chromium nitride in amounts of, in total, from 0.05 to 5% by weight, the remainder being silver, for electrical contacts. In addition, DE-A-39 11 904 discloses a powder-metallurgical process for preparing a semi-finished product for electrical contacts from a silver-based composite material containing iron, in which from 5 to 50% by weight of iron as the first minor constituent and from 0 to 5% by weight of a second minor constituent are used. The second constituent contains one or more substances from the group comprising the metals titanium, zirconium, niobium, tantalum, molybdenum, manganese, copper and zinc as well as their oxides and their carbides. The iron in elemental form is obtained in the process by chemical precipitation, in particular. Finally, JP-A-1/055345 discloses a material of the type mentioned at the outset, which is composed of from 0.5 to 20% by weight of iron oxide particles dispersed in a silver matrix, in which material a portion of the iron oxide is replaced by at least one of the oxides of nickel, cobalt, chromium, molybdenum, tungsten, cadmium, zinc, antimone, tin, bismuth, indium, lead, manganese, beryllium, calcium, magnesium or copper. The contact pieces manufactured therefrom are claimed to be distinguished, for use in switches, by good mechanical properties and high arc resistance.

WO-A-92/22080 discloses a contact material in which, in addition to the iron oxide, rhenium oxide and/or bismuth zirconate and/or boron oxide and/or zirconium oxide are present as a further effective component, the iron oxide being present as the main component in percentages by weight between 1 and 50%, and the minor components being present in percentages by weight between 0.01 and 5%. The iron oxide may here have the constitution $Fe_2O_3$ or $Fe_3O_4$ or alternatively, if required, be of mixed form.

In the materials of the prior art, all the requirements of the "contact property spectrum" are usually not met at the same time. The ultimate aim is to achieve, for each particular application, an appropriate optimum of the parameters most important for that particular case.

SUMMARY OF THE INVENTION

Based on the prior art, the object of the invention is to find further contact materials based on silver-iron oxide and containing other minor components, and to specify the appertaining preparation process. The novel materials are to be distinguished by low contact heating with stable heating behaviour, low tendency to welding and a long service life with respect to the breaking current intensities. Furthermore, good corrosion resistance should obtain.

The object is achieved according to the invention by the further effective component being an oxide of an element of the third sub group of the Periodic Table of the Elements. In addition, at least one oxide may be present which contains elements of the sixth subgroup of the Periodic Table of the Elements. These contact materials are suitable, in particular, for use in a low-voltage circuit breaker.

DETAILED DESCRIPTION OF THE INVENTION

Within the scope of the invention, the iron oxide is preferably present in percentages by weight of from 3 to 20%, and the further effective component in percentages by weight of from 0.1 to 10%. In this context, the iron oxide may in particular be present either in percentages by weight of from 7.5 to 15% or in percentages by weight of from 4 to 7.5%, while the further oxide preferably has a percentage by weight between 0.5 and 2%. The element for the effective component may be selected from the third subgroup of the Periodic Table of the Elements as one of the elements scandium (Sc), yttrium (Y) and lanthanum (La) with the further lanthanides. In particular, however, the further effective component is yttrium oxide ($Y_2O_3$). Particularly good compliance with the requirements posed is provided by a material having the composition $Ag/Fe_2O_3 10/Y_2O_3 1$.

As a further metal oxide in a material of the constitution $Ag/Fe_2O_3/Y_2O_3$, ferrous tungstate ($FeWO_4$) may in particular be present. Particular utility is provided by a material of the composition $Ag/Fe_2O_3 9/Y_2O_3 1/FeWO_4 0.5$.

The preparation of the novel contact materials is effected according to the invention by silver powder and iron oxide powder first being mixed in the predetermined ratio, by this mixture being admixed with the further metal oxides, and by further processing then taking place by alternate sintering and pressing.

The invention provides improved AgNi substitute materials. The higher contact piece erosion in particular, observed in the known substitute materials using iron oxide as the main effective component, in which the iron oxide fraction was chosen to be in particular below 7.5% by weight in order to ensure the temperature behaviour, is now reduced and approaches the erosion of the silver-nickel.

It was found, within the scope of the present invention, that especially iron oxide as the main effective component in conjunction with yttrium oxide as the minor component improves the complete "contact property spectrum" of the contact material.

Further details and advantages of the invention can be deduced from the following description of working examples. This includes a discussion of the accompanying Table containing individual examples for concrete material compositions according to the invention.

In the Table, measured values for the temperature rise of the novel materials, which in each case was measured at the contact bridge of the switching device, are given as maximum and mean bridge temperatures, as well as measured values for the erosion behaviour.

The first column contains the maximum temperature rise in each case, arising in the bridge having the highest temperature values, the second column containing the mean values of all the temperature measurements. The values in each case result as the temperature difference with respect to the room temperature. The third column lists values for the erosion which is calculated from weight measurements. All measurements were carried out in switching sequence tests in a 15 kW contactor up to a number of make-break operations of $n_s$=50,000 switching operations.

The Table contains, in addition to reference materials, a typical example with a meaningful composition of the contact material according to the invention. Measurements were carried out in each case directly on a contact bridge of the 15 kW test contactor, using two contact pieces in each case. The measurement results are discussed below in more detail.

EXAMPLE 1

$Ag/Fe_2O_310/Y_2O_31$ Contact Material

A material having the composition $Ag/Fe_2O_310/Y_2O_31$ is to be prepared. To this end, separate silver powder and iron oxide powder are first mixed in a predefined ratio, and this powder mix is admixed with 1% by weight of yttrium oxide powder. The further preparation is carried out in a known manner by alternate sintering and pressing under predefined constraints.

The contact pieces are produced either by an extrusion technique or a moulding technique. In both cases, the rear sides, in order to ensure reliable connection, are provided, even as they are being fabricated, with a solderable and/or weldable silver layer. The contact pieces thus fabricated, having the constitution $Ag/Fe_2O_3/Y_2O_3$, were subjected in the contactor specified to comparison tests with known contact materials, whose results are depicted in the Table.

The Table first shows an AgNi20 contact material whose properties, both with respect to the bridge temperature and with respect to erosion are known to be good. These values are made considerably worse in $AgFe_2O_3$ contact materials containing only iron oxide as a substitute for nickel, in particular the maximum temperatures observed at individual switch bridges being unacceptably high. At the same time, a rise proportional to the oxide content is observed, whereas the erosion is reduced as expected.

From the prior art, various further additives are already specified as a minor effective component which should improve these properties. Good utility has been shown especially by zirconium oxide ($ZrO_2$), the results being listed in the Table. Here, with a low iron oxide content, especially at below approximately 7.5% by weight of $Fe_2O_3$, a low maximum bridge temperature and an excellent mean bridge temperature are observed, the erosion admittedly being unsatisfactory. The latter drops only at higher iron oxide contents, i.e. from approximately 7.5% by weight of $Fe_2O_3$, a deterioration of the temperature behaviour admittedly being observed at the same time.

It can further be seen from the Table that the temperature behaviour is improved surprisingly, in particular by the addition of yttrium oxide, without the erosion becoming significantly worse. In this context, the yttrium oxide proportion may be in the range from 0.1 and 10% by weight.

The material $Ag/Fe_2O_310/Y_2O_31$ listed in the Table, in particular, is directly comparable in its temperature behaviour with the material AgNi10. In contrast to the previously proposed $AgFe_2O_3$-based materials containing other minor components, the erosion is now, however, significantly below the erosion in the known materials. For example, for a number of make-break operations of 50,000 the erosion observed was only about 20% above that of silver-nickel, whereas it is considerably higher in the other substitute materials.

Owing to, in particular, the properties, equally suitable with respect to the temperature behaviour and the erosion behaviour, of $Ag/Fe_2O_310/Y_2O_31$, the conditions now exist for replacing the silver-nickel materials having the known adverse effects for a wide range of applications. Instead of, in particular, yttrium oxide the other chemical elements of the third sub-group of the Periodic Table of the Elements are also possible as the minor component of an $AgFe_2O_3$ material.

EXAMPLE 2

$Ag/Fe_2O_39/Y_2O_31/FeWO_40.5$ Contact Material

In order to prepare this material, separate silver powder and iron oxide powder are first mixed in a predefined ratio, and this powder mix is admixed with 1% by weight of yttrium oxide powder and 0.5% by weight of iron tungstate powder. The further preparation is carried out in a known manner by alternate sintering and pressing under predefined constraints.

Contact pieces are fabricated from this material either by an extrusion technique or a moulding technique. In both cases, the rear sides are provided, during the fabrication of the contact pieces, with a solderable and/or weldable silver layer to ensure reliable connections of the contact pieces.

The contact pieces thus produced were subjected to comparative tests with, on the one hand, known contact materials and, on the other hand, the materials according to the other examples of the above description.

It was found that, using the material according to Example 2, it is possible not only to attain the suitable temperature properties of the sintered contact materials, already proposed in Example 1, having the constitution $Ag/Fe_2O_3/Y_2O_3$, but also in particular to improve further the welding and short-circuit behaviour. This material is therefore especially suitable for use in circuit breakers.

TABLE

| | Maximum bridge temperature [K.] | Mean bridge temperature [K.] | Erosion of the entire bridge (two contact pieces) [weight loss in g] |
|---|---|---|---|
| AgNi20 | 91 | 68 | 0.13 |
| $AgFe_2O_56.4$ | 162 | 71 | 0.27 |
| $AgFe_2O_310$ | 168 | 87 | 0.18 |
| $AgFe_2O_55.4ZrO_21$ | 89 | 66 | 0.24 |
| $AgFe_2O_510ZrO_21$ | 136 | 78 | 0.16 |
| $AgFe_2O_310Y_2O_31$ | 101 | 74 | 0.16 |

What is claimed is:

1. A composition comprising: silver, iron oxide, and at least one additional oxide of an element of the third subgroup of the Periodic Table of the Elements.

2. The composition according to claim 1 wherein the iron oxide is present in an amount of about 3 to 20% by weight and the additional oxide is present in an amount of about 0.1 to 10%.

3. The composition according to claim 1 wherein the iron oxide ($Fe_2O_3/Fe_3O_4$) is present in an amount of about 7.5 to 15% by weight.

4. The composition according to claim 3 wherein the iron oxide ($Fe_2O_3/Fe_3O_4$) is present in an amount of about 9 to 12% by weight.

5. The composition according to claim 4 wherein the iron oxide ($Fe_{2\ O3}/Fe_3O_4$) is present in an amount of about 4 to 7.5% by weight.

6. The composition according to claim 1 wherein the additional oxide is yttrium oxide ($Y_2O_3$).

7. The composition according to claim 6 wherein the yttrium oxide is present in an amount of about 0.5 to 5% by weight.

8. The composition according to claim 1 comprising $Ag/Fe_2O_310/Y_2O_31$.

9. The composition according to claim 1 further comprising at least one further metal oxide of an element of the sixth subgroup of the Periodic Table of the Elements.

10. The composition according to claim 9 wherein the further metal oxide is ferrous tungstate ($FeWO_4$).

11. The composition according to claim 10 wherein theferrous tungstate ($FeWO_4$) is present in an amount of about 0.1 to 1% by weight.

12. The composition according to claim 9 comprising $AGFE_2O_39/Y_21/FeWO_40.5$.

13. Process for preparing a composition according to claim 1 comprising the steps of:

(a) mixing powders of silver and iron oxide in a predetermined ratio;

(b) admixing at least one oxide of an element of the third subgroup of the Periodic Table of the Elements; and (c) alternately sintering and pressing the mixture.

14. The process of claims 13 further comprising the step of admixing at least one further metal oxide of the an element of the sixth subgroup of the Periodic Table of the Elements prior to step (c).

15. A method of using the composition according to claim 1 comprising fabricating the composition into a contact piece for a switching device.

16. The method of claim 15 wherein the switching device is a low voltage switch.

17. The method of claim 15 wherein the composition is extruded.

18. The method of claim 15 wherein the composition is moulded.

* * * * *